United States Patent [19]

Davenport et al.

[11] 4,226,544

[45] Oct. 7, 1980

[54] WIRE PRINTING HEADS

[75] Inventors: Keith B. Davenport, Sandhurst; Ronald N. Piper, Whitton, both of England

[73] Assignee: Data Recording Instrument Company Limited, Staines, England

[21] Appl. No.: 947,071

[22] Filed: Sep. 29, 1978

Related U.S. Application Data

[63] Continuation of Ser. No. 806,778, Jun. 15, 1977, abandoned.

[51] Int. Cl.[3] ..... B41J 3/12

[52] U.S. Cl. ..... 400/124; 101/93.05

[58] Field of Search ..... 400/124; 101/93.04, 101/93.05

[56] References Cited

U.S. PATENT DOCUMENTS

| | | | |
|---|---|---|---|
| 3,770,092 | 11/1973 | Grim | 101/93.05 X |
| 3,795,298 | 3/1974 | Kodis | 400/124 |
| 3,889,793 | 6/1975 | Cattaneo | 101/93.05 X |
| 3,967,714 | 7/1976 | Potma et al. | 101/93.05 X |
| 3,991,871 | 11/1976 | McIntosh | 400/124 |

FOREIGN PATENT DOCUMENTS

| | | | |
|---|---|---|---|
| 2409890 | 9/1974 | Fed. Rep. of Germany | 400/124 |
| 7510426 | 9/1975 | Netherlands | 400/124 |

*Primary Examiner*—Paul T. Sewell

*Attorney, Agent, or Firm*—Hane, Roberts, Spiecens & Cohen

[57] ABSTRACT

A wire printing head is disclosed in which solenoids are arranged in arcuate configuration, the printing wires being connected in line with their respective solenoids. A wire guide is positioned adjacent the printing line and preformed tubes are used to guide the wires from the solenoids to the wire guide. The tubes are located at the end nearest the guide in a tube support member. An intermediate support member is provided to support the tubes, grooves being cut in the intermediate support member for this purpose. The grooves are sufficiently large to enable the tubes to take up their natural positions within their respective grooves, being secured within the grooves by an adhesive material such as synthetic resin. The solenoids are held by clamps in recesses in the head and the recesses radiate from a common point which also serves as the point from which the arc is struck.

2 Claims, 3 Drawing Figures

WIRE PRINTING HEADS

This is a continuation of application Ser. No. 806,778 filed June 15, 1977 now abandoned.

BACKGROUND OF THE INVENTION

1. Field of the Invention

The present invention relates to wire printing heads for wire printers in which characters are formed from a dot matrix by selective actuation of individual ones of a group of printing wires.

2. Description of the Art

It has previously been proposed to provide printing heads which have a single row of, say, seven print wires arranged in a vertical line with respect to the characters to be printed. The entire head is supported for movement in the direction of a line of characters and the selective actuation of the wires is timed during this movement to form a character as though it had been printed by wires on a matrix of, for example, seven by five cells. It has also been proposed to move the record on which printing is to take place relative to a fixed print head which may have, for example, a row of wires aligned either vertically or horizontally with respect to a character to be printed.

SUMMARY OF THE INVENTION

According to the present invention a wire printing head includes a plurality of printing wires extending away from a printing position; a wire guide adjacent said printing position arranged to support the wires in a predetermined pattern; a plurality of solenoids, a separate solenoid being connected to operate each one of the printing wires respectively; a support body arranged to support the solenoids spaced away from the wire guide; preformed tubes, each printing wire being guided within an associated tube; an intermediate support positioned between the wire guide and the support member having a plurality of slots therein, a separate slot being provided for each one of the tubes respectively, each slot being sufficiently large to permit its associated tube freely to take up its natural attitude within the slot and adhesive material applied about the tube in each slot to secure the tube in said slot in that attitude.

A tube guide intermediate the wire guide and the intermediate support may be provided to locate the ends of the tubes with respect to the wire guide. The intermediate support may be arcuate, the arc springing from a common point intermediate the intermediate support and the tube guide and the axes of the recesses may also radiate from the same point.

BRIEF DESCRIPTION OF THE DRAWING

Apparatus embodying the present invention will now be described, by way of example, with reference to the accompanying drawings, in which.

DESCRIPTION OF THE PREFERRED EMBODIMENT

Figure 1:
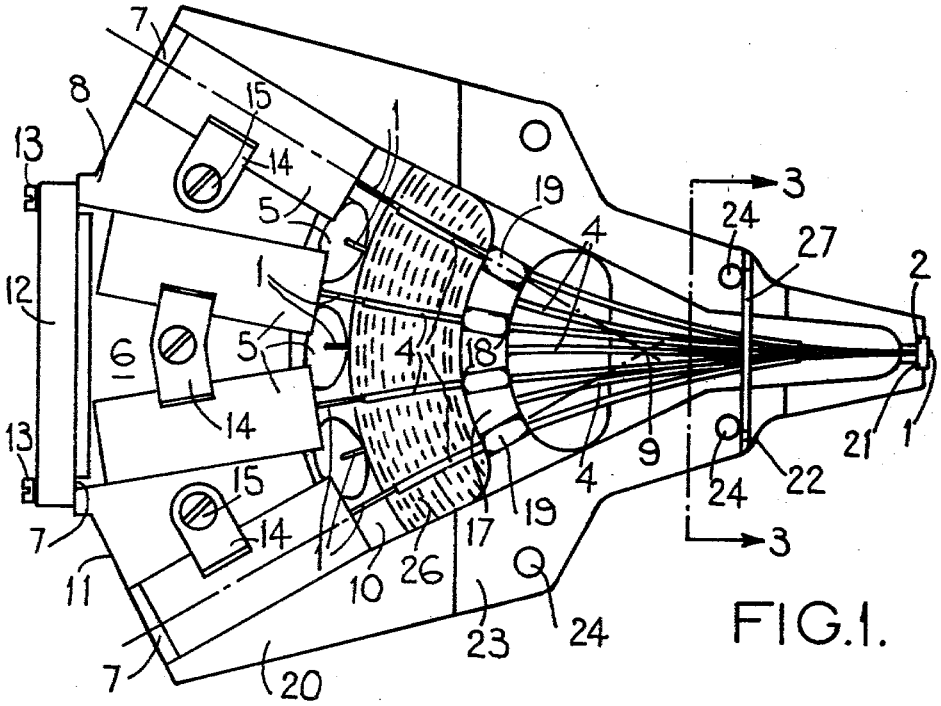
FIG. 1 is a view of a wire printing head.
Figure 2:
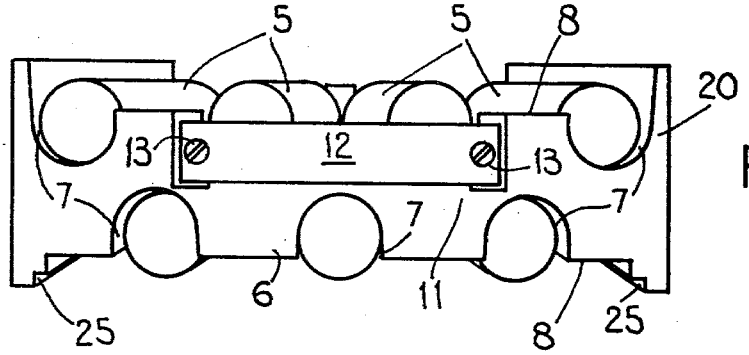
FIG. 2 is an end view of the head of FIG. 1.

Referring now to the drawings, a wire printing head has a group of printing wires 1, projecting in a line through a wire guide 2 consisting of a block of synthetic jewel material. The printing wires 1 pass through guide tubes 4 and are attached respectively to the armatures (not shown) of actuating solenoids 5. In passing from the guide 2 to the solenoids 5, the wires 1 are formed into two groups and are fanned out in order to separate them from each other to provide sufficient space for the solenoids 5.

In order to avoid sharp bends and to minimise friction between the wires 1 and the interior of the tubes 4, the guide tubes 4 are preformed into curves of predetermined radius and the wires 1 are also preformed into the same curves. The solenoids 5 are supported in recesses 7 in a support member 6. In the example illustrated in the drawings, seven print wires are provided and the recesses 7 are provided in two groups, of three and four respectively, in opposite faces 8 of the support member 6. Each recess 7 is preferably aligned so that the solenoids 5 are in axial alignment with the wires 1, the longitudinal axes of the solenoids 5 being tangential to the curves of the respective wires 1. Thus, the support member 6 is preferably wedge-shaped, tapering towards the ends of the solenoids from which the wires 1 project. The axes of the recesses 7 conveniently radiate from a point 9 lying intermediate the member 6 and the guide 2 and it is also convenient for at least the inner face 10 of the support member 6 to lie in an arc sprung from the same point 9.

The outer face 11 of the member 6 is formed to support a terminal block 12 secured, for example, by screws 13, the block 12 providing electrical connections for the terminal leads of the solenoids 5, the leads being omitted from the drawings for the sake of clarity.

Clamps 14 are provided, secured by screws 15, to hold the solenoids 5 firmly against movement in the recesses 7.

Figure 3:
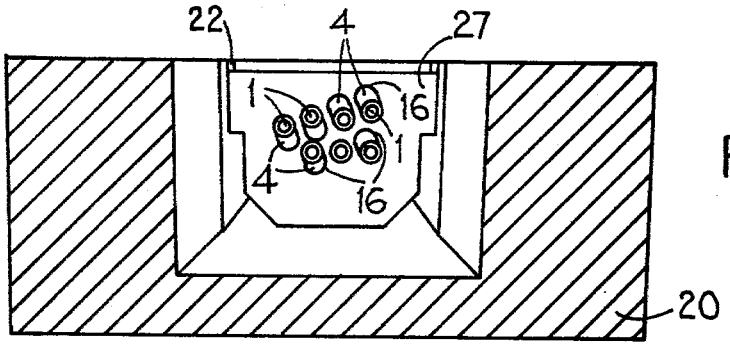
FIG. 3 is a sectional view taken on the lines 3—3 of FIG. 1.

Between the wire guide 2 and the member 6, a tube guide plate 27 is provided. It will be realised that the wires 1 are aligned at the guide 2 in a single row running in a direction perpendicular to the groups of solenoids 5 on either face of the member 6, and the tube guide plate 27, as best shown in FIG. 3, carries guide holes 16 arranged in two oblique rows to locate the ends of tubes 4 near the guide 2 to aid the formation of the wires 1 into the required printing configuration; in this case, the single row.

A second support 17 is provided between the wire guide 2 and the first support member 6 in a position nearer to the support member 6 than the guide plate 15. The support 17 conveniently follows an arc struck from the common point 9 so that it is evenly spaced from the inner face 10 of the support 6. The upper and lower faces, as indicated in the drawings, of the second support 17 carry slots 18, one for each tube 4 respectively and each slot 18 is larger, that is to say considerably wider and deeper, than the external diameter of a tube 4. Thus, the tubes 4 are able to assume natural unconstrained positions within the slots 18 according to their preformed curvature. During manufacture, once the tubes 4 are settled in their positions they are secured in place by an adhesive casting material 19, such as a synthetic resin.

In order to facilitate and to reduce the cost of head assembly, for example, it is convenient to incorporate the support member 6 and the support 17 into a unitary structure which may readily be produced, say, by die-casting techniques. As shown, the support member 6 forms one end of a tapering body 20 whose other end is formed into a recess 21 to accommodate the wire guide 2. A slot 22 is provided to receive the plate 27 which is secured in place with adhesive material as is the wire guide 2. A flat flanged area 23 is provided to facilitate mounting of the head in wire printing apparatus of conventional form and holes 24 in this area are provided to accommodate fixing screws (not shown). Additional locating holes or slots may also be provided as required. Similarly, a recess, such as that referenced 25 may be provided to receive a cover plate (not shown) for the protection of the wires 1 and solenoids 5 when the head is installed in the apparatus.

Finally, a felt pad 26 may be provided between the two rows of wires 1 and tubes 4 and the pad 26 may then be impregnated with oil to lubricate the wires 1.

In assembling the head, the body 20 is first fitted with the wire guide 2, the guide 2 and the body being held in a jig, for example, while the adhesive material, such as a synthetic resin, is set and cured. The tube guide plate 27 is secured in position before the tubes 4 are assembled in place. The solenoids 5 (which may be of conventional construction within a metal outer sleeve, the operating coil being in good thermal contact with the sleeve) are assembled and adjusted, the wires 1, which are all the same length, having their free ends dressed before being assembled to the armatures (not shown) of the solenoids 5. This ensures that the wire ends are correctly formed for clean printing but because the dressing operation is completed before assembly any grinding and cleaning operations are performed without any danger of contaminants entering, for example, the wire guide 2, which might cause undue wear in use.

The assembled solenoids are fitted to the head in turn, the printing wires 1 being threaded through their respective tubes 4 and into their appropriate positions in the guide 2. During this operation, the solenoids are loosely retained in their recesses 7, being lightly clamped by clamps 14. The assembled head is fitted to an adjustment jig in which the tubes 4 are first aligned between the guide plate 27 and their respective solenoids, care being taken that all the tube ends projecting from the plate 27 are clear of neighbouring wires 1. The solenoids 5 are then positioned longitudinally in their recesses 7 so that the printing wires 1 all project a predetermined distance from the outer face of the guide 2. The adjustment jig preferably has pins which are positioned to register with selected points on the head structure, such as the holes 24 or the dowel slots or holes previously referred to but not illustrated. The projection of the printing wires 1 is then adjusted with reference to an accurately located surface on the jig. In this way the printing wires 1 are all conveniently formed to the same length and any positional adjustment required is obtained by allowing the solenoids 5 to move longitudinally within the recesses 7. Once the initial adjustment of the tubes 4 and wires 1 is completed, the tubes 4 are secured in their positions by the adhesive 19 as described and when the adhesive is set, the assembled head may be removed from the jig.

During use of the head for printing operations the tips of the printing wires will become worn as is usual in printers of this kind. The present print head, however, is so constructed that adjustment to compensate for this wear is readily and easily carried out. The head is once more inserted in an adjustment jig, the clamps 14 are loosened and the printing wire ends are again aligned, the solenoids 5 being free to take up new positions as required. Once readjusted, the clamps 14 are again tightened to retain the solenoids 5 in their new positions. Replacement of worn or faulty components is effected in much the same way, a solenoid 5 and an associated preformed wire 1 being treated as a single unit for replacement purposes.

It will be seen that the above method of solenoid positioning and adjustment has considerable advantages over conventional methods in which, for example, a solenoid has a screwed nose which fits into a threaded hole in a support member, the solenoid being adjusted in an axial direction by being twisted so that it is screwed one way or the other in the support. Because this adjustment requires twisting of the solenoid into a precise attitude, it will be seen that preforming of, for example, the wires is not practicable, or may be employed only at the expense of a double adjustment of solenoid position and wire attitude. In addition, the absence, in the present arrangement, of the need for twisting the solenoid reduces one possible cause of damage to the solenoid connection wires.

As the design of wire printing heads has improved with the passage of time, the ever higher speed requirements allied to the need for as compact construction as is possible in order to meet such requirements has resulted in the need to use relatively large driving currents applied to small solenoids, with the result that effective cooling has proved to be a problem and the thermal characteristics of electromagnetic actuators such as the solenoids tend to pose a restrictive limitation on continuous operation. In the present arrangement the support member 6 and, indeed, the entire body 20 provides an effective heat sink since the solenoid coils are in good thermal contact with the solenoid outer sleeves which in turn are in good thermal contact with the recesses 7.

While the present head has been described as having seven printing wires arranged in single row configuration it will be realised that heads with other numbers of wires are readily constructed using the same principles. Equally, it is not necessary for the alignment of the row of printing wires to be perpendicular to the rows of solenoids. Indeed, in other constructions of heads using the same principles, the printing wires may be arranged in full matrix configuration.

I claim:

1. A wire printer head including a body member; a plurality of printing wires; a first end of each wire effective for printing; a wire guide on said body member supporting said wires in closely spaced relationship adjacent said first ends; a second end of each wire opposite to said first end; a plurality of solenoids each connected to a different one of said second ends of said wires, each solenoid being operable to cause longitudinal movement of the wire connected thereto to effect printing by the first end of that wire; a support member on said body member supporting a group of the solenoids in a first arcuate formation and the remainder of the solenoids in a second arcuate formation so that the wires extend from said wire guide to said solenoids along a plurality of diverging smooth curves; a plurality of curved tubes; each wire extending through a different one of said tubes, the wires connected to said group of solenoids extending through a first group of the curved tubes and the wires connected to the remainder of the solenoids extending through a second group of the curved tubes, each tube having a length less than the length of the wire extending therethrough and said tubes being preformed to a curvature substantially corresponding to the curvature of the wire extending therethrough; a tube guide plate on the body member adjacent the wire guide and effective to locate one end of each tube in alignment with the curve of the wire enclosed therein; a further support member on the body member spaced from the tube guide plate and extending between the first group of tubes and the second group of tubes; the further support member having a plurality of open-ended slots in first and second opposite faces for receiving the tubes, each of said slots being sufficiently large to ensure that the tubes extend in positions determined by the wires extending therethrough without constraint from the further support member, each of the tubes of the first group being secured respectively in a slot in the first face by a casting of adhesive material in said slot and each of the tubes of the second group being secured respectively in a slot in the second face by a casting of adhesive material in said slot.

2. A wire printer head including a body member;

a plurality of printing wires, a first end of each wire effective for printing and a second end opposite said first end;

a wire guide on said body member supporting said wires adjacent said first ends in closely spaced relationship;

a support member on said body member;

a plurality of solenoids mounted on said support member in an arcuate formation and each including an armature;

said wires extending in a plurality of diverging curves from said wire guide to said solenoids and the second ends of the wires each being secured to the armature of a different one of the solenoids respectively;

a plurality of curved tubes; each wire extending through a different one of said tubes and each tube being preformed to a curvature substantially corresponding to the curve of the wire extending therethrough;

a tube guide plate on the body member adjacent the wire guide effective to locate one end of each of said tubes in alignment with the smooth curve of the wire extending therethrough; and a further support member on the body member spaced from the tube guide plate and extending adjacent the tubes, said further support member having a plurality of open ended slots receiving the tubes, each of said slots being sufficiently large in depth and width to ensure that the tubes extend in positions relative to the further support member determined by the wires extending therethrough without constraint from the further support member and the tubes being secured in said positions relative to the further support member, one in each slot, by a casting of adhesive material in each slot.

* * * * *